US007399201B1

(12) United States Patent
Khorsand

(10) Patent No.: US 7,399,201 B1
(45) Date of Patent: Jul. 15, 2008

(54) ELECTRONIC DEVICE CHARGING PLATFORM AND PORTABLE ELECTRICAL OUTLET ENCLOSURE

(76) Inventor: Amir C. Khorsand, 6920 SW. 44th St., Apt. 109, Miami, FL (US) 33155

( * ) Notice: Subject to any disclaimer, the term of this patent is extended or adjusted under 35 U.S.C. 154(b) by 0 days.

(21) Appl. No.: 11/708,830

(22) Filed: Feb. 21, 2007

Related U.S. Application Data

(60) Provisional application No. 60/775,672, filed on Feb. 22, 2006.

(51) Int. Cl.
*H01R 13/72* (2006.01)

(52) U.S. Cl. ..... 439/501; 174/559; 174/560

(58) Field of Classification Search ..... 439/501; 174/559–562
See application file for complete search history.

(56) References Cited

U.S. PATENT DOCUMENTS 2,457,347 A * 12/1948 Casler et al. ..... 174/561
3,354,454 A * 11/1967 Rueger ..... 340/815.49
3,579,046 A * 5/1971 Jordan ..... 174/535
4,249,196 A * 2/1981 Durney et al. ..... 257/665
4,766,277 A * 8/1988 Bigelow, Jr. ..... 200/293
4,944,694 A * 7/1990 Dorn ..... 439/501
2005/0130492 A1* 6/2005 Noh ..... 439/501

* cited by examiner

*Primary Examiner*—Michael C Zarroli
(74) *Attorney, Agent, or Firm*—Gold & Rizvi, P.A.; H. John Rizvi; Glenn E. Gold

(57) ABSTRACT

An electronic device charging platform and portable electrical outlet enclosure providing a secure, accessible location for the placement and charging of an electronic device on the exterior of the enclosure, while having an interior space to house, use, and conceal a portable electrical outlet device, such as a surge protector or outlet strip, with any power cords and plugs, transformers, or consumer electronic product charging components that are associated with the surge protector is disclosed. The electronic device charging platform and portable electrical outlet enclosure will preferably include a right half and left half, configured so that, as they attach together to create the interior space, slots or notches in each half align to form conduits through which the cords can be routed to the exterior. Additional conduits to the exterior may also be provided for convenience in cord placement and routing.

20 Claims, 4 Drawing Sheets

ELECTRONIC DEVICE CHARGING PLATFORM AND PORTABLE ELECTRICAL OUTLET ENCLOSURE

CROSS-REFERENCE TO RELATED APPLICATION

This application claims the benefit of co-pending U.S. Provisional Patent Application Ser. No. 60/775,672, filed on Feb. 22, 2006, which is incorporated herein in its entirety.

BACKGROUND OF THE INVENTION

1. Field of the Invention

The present invention relates generally to an apparatus specialized to mount, support, and house an electrical device, and more specifically to an electronic device charging platform and portable electrical outlet enclosure configured for use with electronic devices and with a portable electrical outlet device such as a surge protector or power strip.

2. Description of the Prior Art

The number and types of consumer electronic devices continue to grow phenomenally. These consumer electronic devices, such as cell phones, cameras, music and video players, music and video recorders, wireless headsets, cordless phones, computer accessories, and the like, each come with their own cord, plugs, wiring, transformer, charger, and/or other accessories requiring power. For the average home and office, this results in a tangle of cluttered cords around some type of portable electrical outlet device such as a surge protector, power strip, or the like. Powering and charging of these consumer electronic devices in a safe, suitable, convenient, and attractive location has become a problem. The extent of the problem and the huge numbers of devices involved are exemplified by the 200 million cell phones owned by about 70% of the population of the U.S. (CTIA—the Wireless Association) and by the 62 percent or 70 million U.S. households owning one or more computers typically attached to a surge protector (U.S. Census Bureau, 2003).

Not only is this tangle of cords unsightly and inconvenient, but it is also a safety hazard. There is a need to control access and to provide spill resistance. Cords are more likely to become entangled or damaged when they are exposed. When children and pets have ready access to these electrical components they can pull, jerk, or chew on cords damaging the wires and presenting both an electric shock hazard and a fire hazard.

There have been a number of attempts to address these problems. Some enclosures that provide a centralized location for portable electrical outlet devices, connections, and associated wiring do not conceal the connections in an interior space, thereby not solving the safety, access, or aesthetics issues. Some enclosures do enclose the electrical outlets, connections, and wiring, but do not allow for ease in accessing the connections or for ease in plugging and unplugging components. A portion of the enclosures currently available are cumbersome or bulky, occupying a large footprint of floor or desk space. It would be advantageous to provide an attractive enclosure solution that was designed to efficiently use and conserve space, as generally space is at a premium in the locations where the enclosure would be used in a home or office.

Other enclosures contain portable electrical outlet devices, such as surge protectors or power strips, but are additionally adapted for a particular use rather than for general home and office use with consumer electronic products. They include enclosures that, for example, are specialized for use with hair care appliances, medical devices, or multimedia cables, or that are specifically designed for insertion in furniture units or other specific applications, such as an office conference table.

Another need is for a secure area or platform to hold and charge a readily-accessible consumer electronic device, while also having an enclosure to conceal a portable electrical outlet device such as a power strip or a surge protector and to organize the many cords, plugs, wiring, transformers, chargers that are associated with the portable electrical outlet device. There is a need for this platform and enclosure to use orthodox and readily available portable electrical outlet devices, and to be used with orthodox and readily available electronic products. Also, there is a need to provide an attractive platform and enclosure solution that does not occupy a large footprint by consuming a lot of floor or desk space.

Accordingly, there is an established need for an electronic device charging platform and portable electrical outlet enclosure configured for use with consumer electronics and for use with a portable electrical outlet device that increases safety, aesthetics, and convenience by providing for attractive concealment and organization of a portable electrical outlet device and a wide variety of cords, plugs, wires, transformers, and chargers of electronic devices, while allowing good access to the interior of the enclosure/organizer, while being space-efficient and only occupying a small footprint, and while additionally providing a handy, secure, and accessible location to store and charge a consumer electronic device.

SUMMARY OF THE INVENTION

The present invention is directed to an electronic device charging platform and portable electrical outlet enclosure. This platform and enclosure is configured for use with consumer electronics and with a portable electrical outlet device, such as a surge protector or outlet strip. The present invention provides an easily accessible external location for the placement and charging of consumer electronics while providing a safe, convenient, and attractive housing for a portable electrical outlet device and any electrical cords, plugs, transformers, or consumer electronic product charging components that are plugged into the electrical outlets of the portable electrical outlet device.

The platform and enclosure is comprised of a right half and a left half, which can be attached together to define an interior space configured for placement of the portable electrical outlet device, electrical cords, plugs, transformers, chargers, and the like. The two halves include notches or slots that, when the two halves are joined together, align and form conduits through which cords can be routed to the exterior. The two halves, when attached together, also provide an electronic device charging platform, which is a convenient location to store, charge, and access consumer electronic devices.

An object of the present invention is to provide an electronic device charging platform and portable electrical outlet enclosure that can be adapted for use with a wide variety of available portable electrical outlet devices, such as surge protectors and power strips.

A further object of the present invention is that this platform and enclosure can be adapted for use with a wide variety of accessories for consumer electronic devices, such as power cords, plugs, transformers, and chargers.

Another object of the present invention is that this platform and enclosure provide a convenient external cradle-type platform location designated for the placement and charging of an electronic device that can be adapted for use with a wide variety of available electronic devices.

It is an object of the present invention to allow easy access to the interior area of the platform and enclosure for convenient placement and routing of any power cords, plugs, transformers, and chargers, and portable electrical outlet devices.

A further object of the present invention is to provide easy access to both the electronic device on the cradle-type platform, as well as to provide easy access to any cords and cord fittings extending out of the enclosure.

Another object of the present invention is to increase safety by enclosing a portable electrical outlet device and consumer electronic product accessories, such as power cords, plugs, transformers, and chargers, away from children and pets.

A further object of the present invention is to increase spill resistance by the use of the portable electrical outlet enclosure.

An additional object of the present invention is to provide a compact enclosure with a small footprint that can combine both an external location for charging an electronic product and an internal area to house a portable electrical outlet device and consumer electronic product accessories.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate but not to limit the invention, where like designations denote like elements, and in which.

Like reference numerals refer to like parts throughout the several views of the drawings.

DETAILED DESCRIPTION OF THE PREFERRED EMBODIMENTS

As shown throughout the figures, the present invention is directed towards a safe, attractive, and convenient electronic device charging platform and portable electrical outlet enclosure to not only support and allow easy access to an electronic device while charging, but also to house a portable electrical outlet device and organize any associated electronic device power accessories, such as electrical cords and plugs, transformers, and chargers. The platform and enclosure of the present invention is preferably sized and configured internally for use with a wide variety of portable electrical outlet devices, such as power strips and surge protectors, electrical cords, electrical plugs, transformers and consumer electronic product charging components, as well as configured externally to support and hold one or more of a wide variety electronic products, for example cell phones, cameras, various music and video players, various music and video recorders, cordless phones, computer accessories, and the like.

Figure 1:
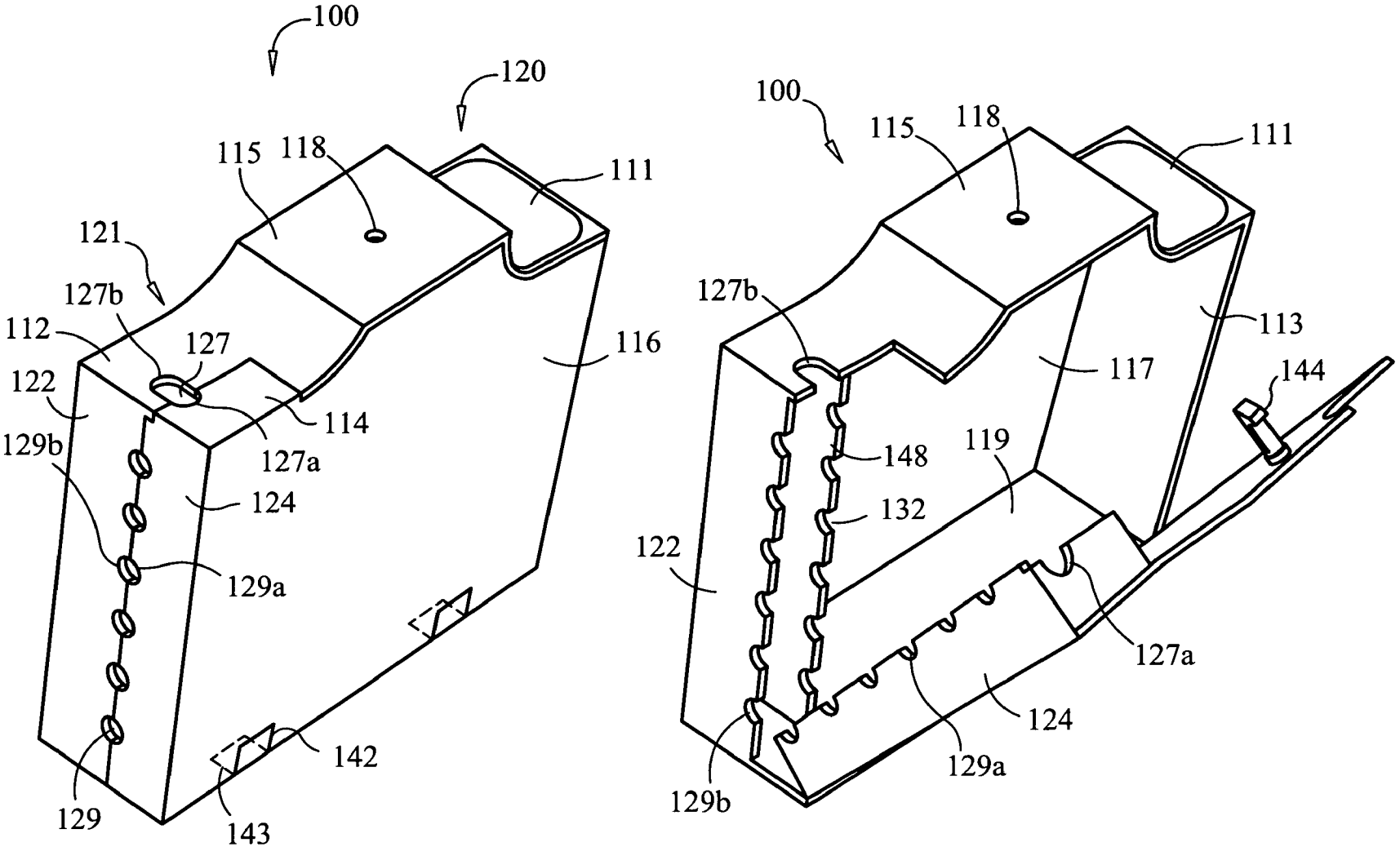
FIG. 1 is a perspective view of the first embodiment of the electronic device charging platform and portable electrical outlet enclosure of the present invention, illustrating both the open position and the closed position of the present invention.

Referring now to FIG. 1, a electronic device charging platform and portable electrical outlet enclosure, shown generally as reference number 100, is illustrated in accordance with a first exemplary embodiment of the present invention. The platform and enclosure 100 is shown as a generally rectangular-shaped box, although rounded, octagonal, or other shapes of enclosures can optionally be utilized, and is formed of a suitable substantially rigid non-conductive material, such as, for example, plastic or other polymer.

The platform and enclosure 100 includes, as viewed from the front, a bottom wall 119, a left side wall 116, a right side wall 117, a rear wall formed by both right exterior rear wall 122 and left exterior rear wall 124, a front wall 113, and a top wall comprised of a generally horizontal central top section 115, top forward section 120, and top rearward section 121. The horizontal central top section 115, top forward section 120, and top rearward section 121 may be generally in the same plane (not shown) or alternatively the horizontal central top section 115 may be in a somewhat higher plane than the top forward section 120 and top rearward section 121.

The top rearward section 121 comprises two segments, the top right rearward section 112 and the top left rearward section 114, with the top right rearward section 112 generally perpendicularly connected to the rearward section of right exterior rear wall 122 and with the top left rearward section generally perpendicularly connected to the rearward section of left exterior rear wall 124. When the electronic device charging platform and portable electrical outlet enclosure is in the closed position, the top right rearward section 112 and the top left rearward section 114 are positioned together to form rearward section 121.

Figure 3:
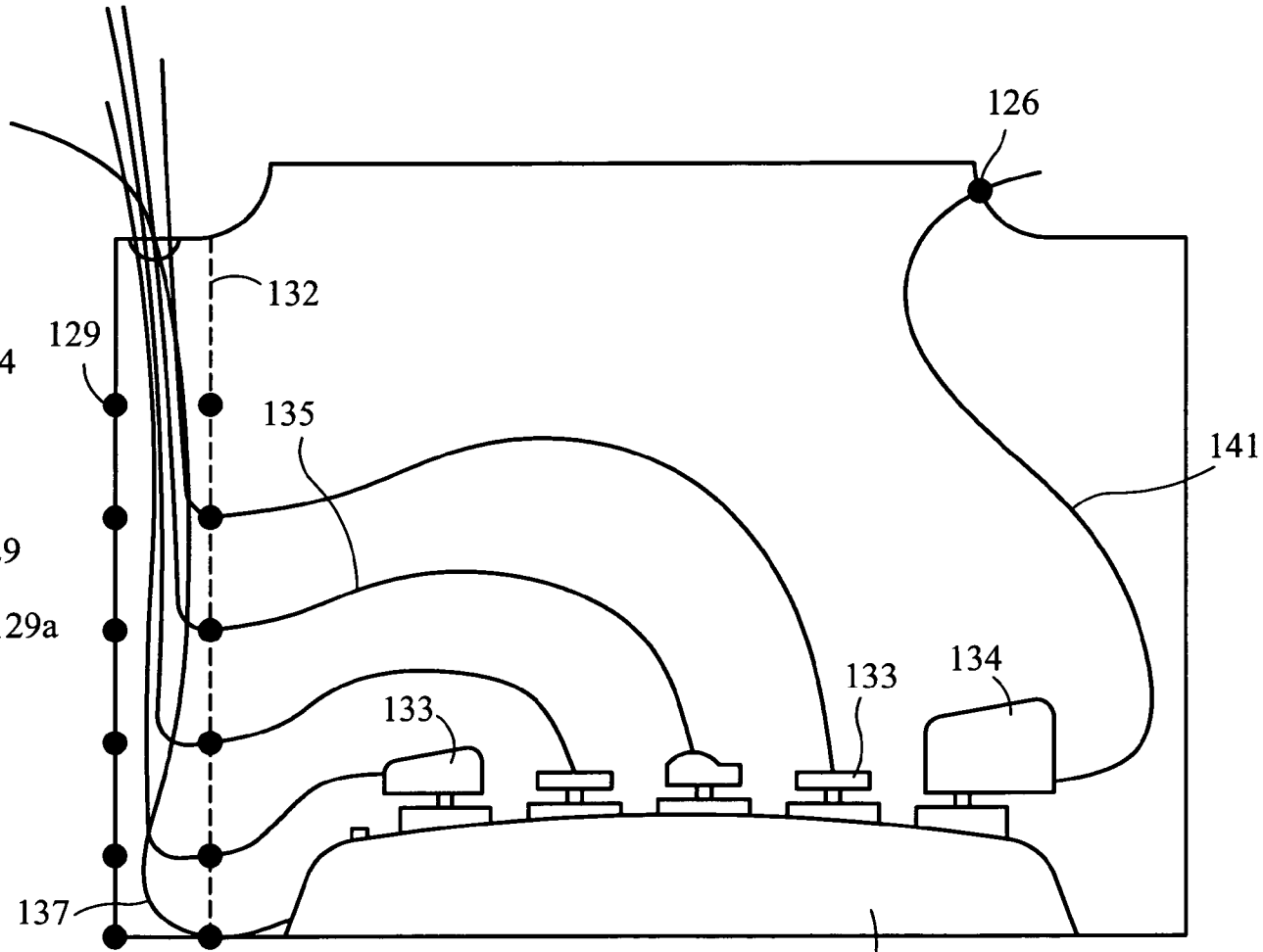
FIG. 3 is a diagrammatic cutaway side view of the interior of the first embodiment of the electronic device charging platform and portable electrical outlet enclosure of the present invention showing a vertical placement of the electrical cords.
Figure 2:
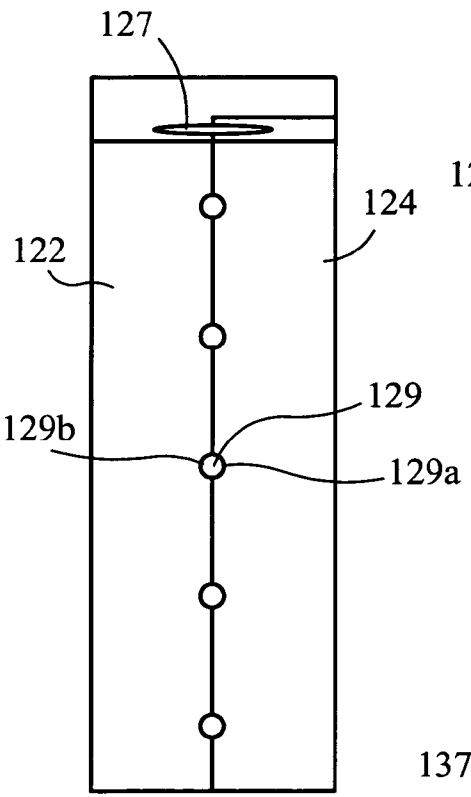
FIG. 2 is an end view of the rear wall of the first embodiment of the electronic device charging platform and portable electrical outlet enclosure of the present invention.
Figure 6:
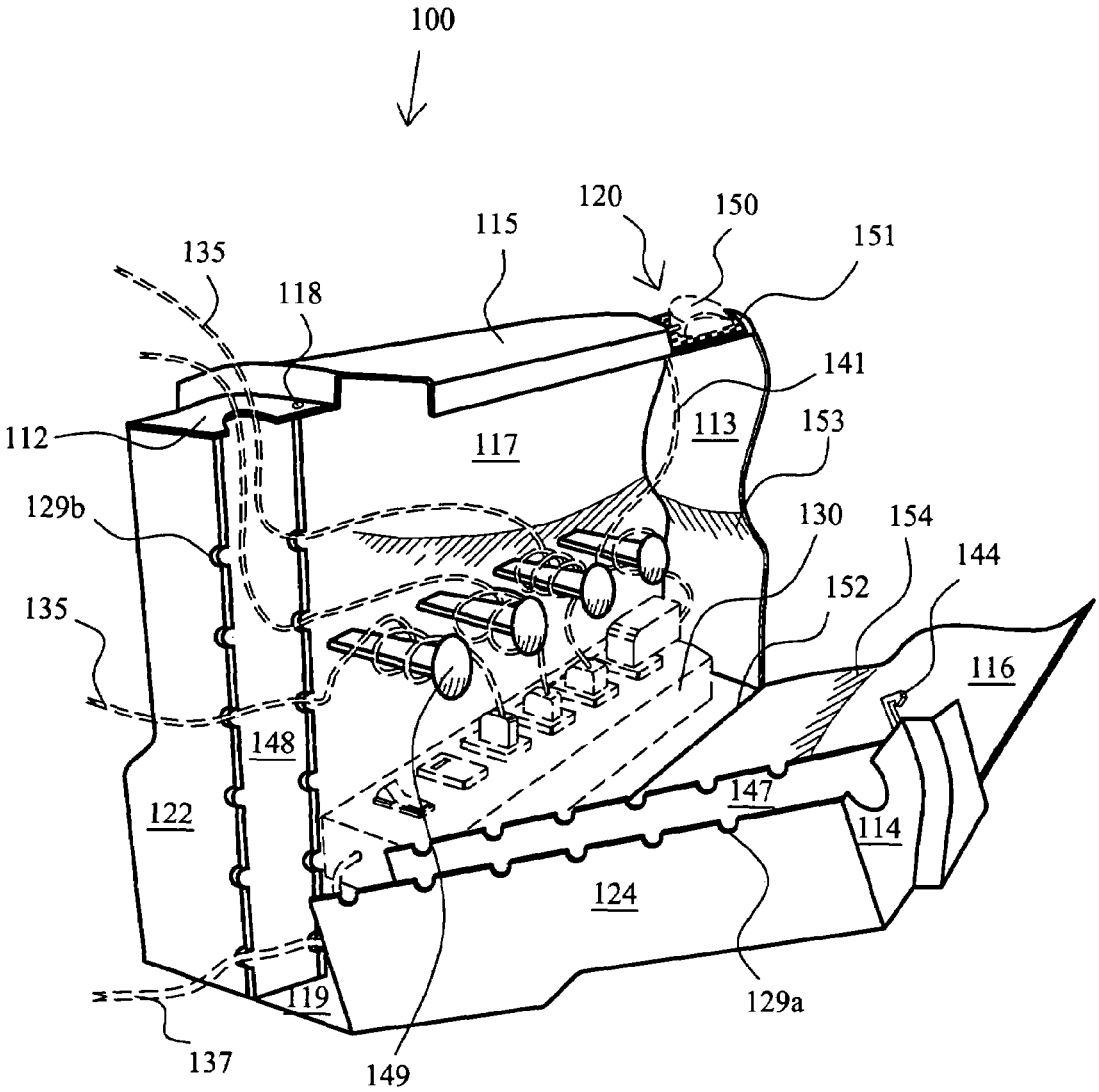
FIG. 6 is a back perspective view of the second preferred embodiment of the electronic device charging platform and portable electrical outlet enclosure of the present invention, illustrating the open position of the present invention.

Platform and enclosure 100 is made up of two separate halves that cooperatively define an interior when joined in a closed position, but that can be separated to allow access to the interior in an open position. The defined interior is sized appropriately to accommodate any of a variety of portable electrical outlet devices, shown as a power strip or surge protector 130 (FIG. 3, FIG. 6).

The right half comprises right side wall 117, front wall 113, right exterior rear wall 122, central top section 115, top forward section 120, right top rearward section 112, and bottom wall 119. The left half comprises left side wall 116, left top rearward section 114, and left exterior rear wall 124. The right half can be connected to the left half by any known latching mechanism as an upper connection and by any known connecting mechanism forming a lower connection.

The latching mechanism is illustrated as a latch 144 (FIG. 1, FIG. 6) extending from upper interior left side wall 116 to connect in operative association to a holding mechanism (not shown) inside central top section 115 with a release hole or fitting 118 configured to allow for releasing the latch from the holding mechanism.

In the first embodiment of the present invention, the connecting mechanism is illustrated as a conventional female-male clip means, a typical female receiving clip 142 (on lower edge of left side wall 116) in operative association with a typical male connector clip 143 (inside interior on left edge of bottom wall 119). This allows the right half and left half to be easily joined together and easily taken apart. Alternatively, other conventional connecting mechanisms as are known in the art can be used to operatively connect the lower edge of left side wall 116 with the left edge of bottom wall 119, such as, for example, hinges, interlocking tabs, or a flexible joint or fold line. It will be appreciated by those skilled in the art that any of a wide variety of different latching mechanisms 144, connecting mechanisms, clip means 142, 143 or hinge means may be utilized without departing from the present invention, and, in addition, that the location, size and orientation of latching mechanism 144 or the connecting mechanism can be varied as a function of the dimensions of the enclosure or varied to increase the aesthetic appeal of the electronic device charging platform and portable electrical outlet enclosure of the present invention.

Top forward section 120 has a forward opening 126 (FIG. 3) which is sized to allow a cord such as a transformer or charger cord 141 with its attached tip or fitting to be manually fed from the inside of the enclosure through the forward opening 126 to the exterior of the enclosure. Forward opening 126 can optionally be fitted with a nipple (not shown) of rubber or other polymer that has an opening that allows cord 141 with its attached tip to be threaded through, thereby minimizing the chance that the tip could slip backward into the interior of the enclosure. Top forward section 120 also has a cradle 111 (FIG. 1) that is sized and designed to conveniently hold a consumer electronic product. The cradle 111 can be rubberized or lined with other non-slip material to provide a firm and secure base for the consumer electronic product.

Left exterior rear wall 124 and right exterior rear wall 122 are both configured with cut outs along their edges, shown as uniformly spaced rounded exterior left rear slots 129*a* and exterior right rear slots 129*b* appropriately sized and shaped to accommodate orthodox sizes of electrical cords. When the two halves are joined together the slots 129*a* align with and meet slots 129*b* forming a generally smooth-edged passageway for electrical cords, an exterior conduit 129. These exterior conduits 129 are designed to hold and route surge protector cord 137 (attached to surge protector 130) and electronic device cords 135 (that extend from the transformers, chargers, or plugs 133 of various consumer electronic products that are inserted into surge protector 130). In a similar manner, the right top rearward section 112 and the left top rearward section 114 are configured with somewhat larger first and second cut outs, shown as generally U-shaped first top notch 127*a* and second top notch 127*b* which join together to form a generally somewhat elongated, smooth-edged passageway for electrical cords, top conduit 127, allowing room for one or more cords 135 and/or cord 137. These exterior conduits 129 and top conduit 127 can be lined with rubber or another polymer or material, if desired.

Internally, the substantially open interior of the platform and enclosure 100 allows room for surge protector 130 (FIG. 3, FIG. 5, FIG. 6) to be positioned lying on bottom wall 119 with its attached cord 137 being routed to the outside of platform and enclosure 100, either through top conduit 127 or through one of exterior conduits 129. One or more transformers or chargers for a consumer electronic device, such as a charger 134, can be plugged into surge protector 130 with a cord 141 routed from the interior to the exterior of platform and enclosure 100 through forward opening 126. Additional transformers, chargers, or plugs from electronic or electrical devices can be plugged into surge protector 130 with their cords routed through exterior conduits 129 and/or top conduit 127.

An additional interior back wall can be provided to assist in the organization and placement of cords 135, 137. This interior back wall is formed by left interior rear wall 147 (FIG. 6) and right interior rear wall 148, configured similarly to left exterior rear wall 124 and right exterior rear wall 122. When the two halves are joined together the interior slots or cut outs on each side align to form interior rear wall conduits 132 designed to accommodate cords 135, 137. Right interior rear wall 148 is attached to, and extends perpendicularly from, the inside of right side wall 117 somewhat in front of, and parallel to, right exterior rear wall 122. In a similar way, left interior rear wall 147 is attached to, and extends perpendicularly from, the inside of left side wall 116 somewhat in front of, and parallel to, left exterior rear wall 124. Although exterior conduits 129, top conduit 127, interior rear wall conduits and cut outs 127*a*, 127*b*, 129*a*, 129*b*, and 132 are illustrated as having a generally circular/oval shape and uniform spacing, it will be appreciated by those skilled in the art that without departing from the present invention, any of a wide variety of different shapes, such as, for example, square, rectangular, octagonal, or the like, may be utilized, as well as that a variety of uniform and non-uniform spacings may be utilized.

To use the platform and enclosure 100, the two halves are snapped apart to allow for the placement of surge protector 130. One or more chargers 134 or plugs 133 from various electronic devices or from various electrical devices, such as fans and lights, are plugged into surge protector 130. The cords 135, 137, 141 can be positioned and routed as desired.

One routing method for cords 135, 137 is shown in FIG. 3, with cords 135 and cord 137 first routed through interior rear wall conduits 132. Then, the cords, being somewhat confined together between interior rear walls 147, 148 and exterior rear walls 122, 124 are routed upward through top conduit 127, and out to their respective devices.

Figure 5:
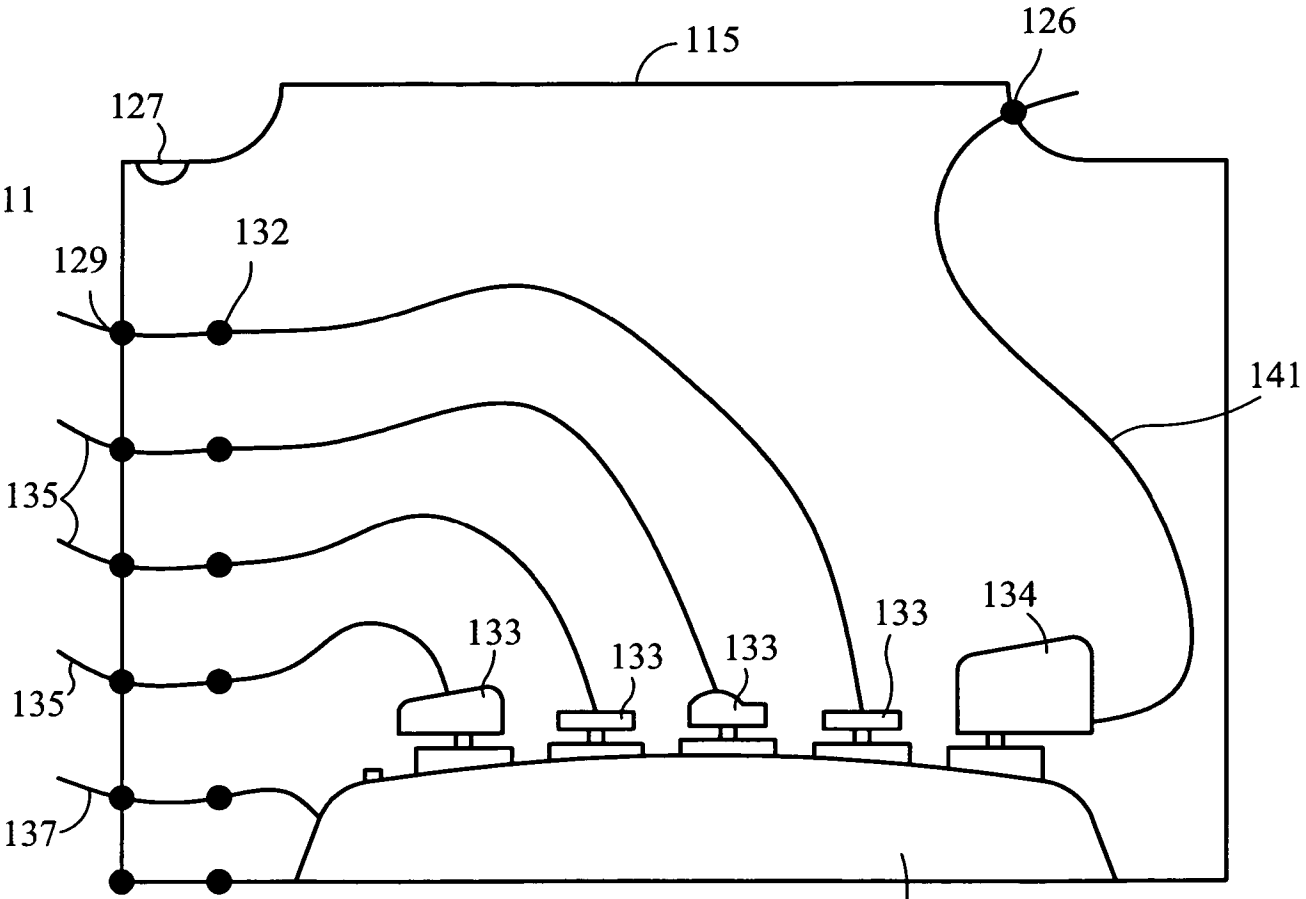
FIG. 5 is a diagrammatic cutaway side view of the interior of the first embodiment of the electronic device charging platform and portable electrical outlet enclosure of the present invention showing horizontal placement of the electrical cords.
Figure 4:
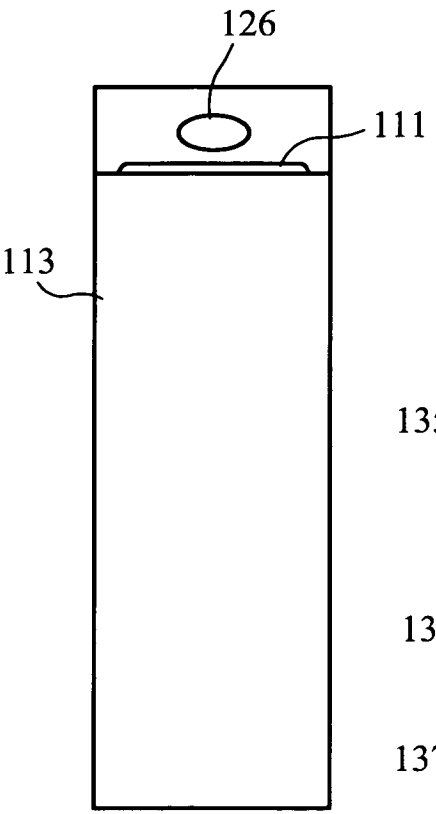
FIG. 4 is an end view of the front wall of the first embodiment of the electronic device charging platform and portable electrical outlet enclosure of the present invention.

A second routing method is shown in FIG. 5 with cords 135, 137 being routed first through interior rear wall conduits 132, and then horizontally through exterior conduits 129, then out to their respective devices. Alternatively, other routing methods using any combination of exterior conduits 129, top conduit 127, and forward opening 126 could be used.

Extending from the one or more transformers or chargers 134 plugged into surge protector 130 is cord 141 and its associated tip, which is threaded through forward opening 126 to the top front of the platform and enclosure 100, thereby providing quick and easy access to the tip of cord 141 to allow an electronic device to easily be connected and disconnected, as required. The two halves of platform and enclosure 100 are then joined back together by utilizing latching mechanism 144 and female-male clip means 142, 143, to conceal surge protector 130, plugs 133, cords 135, cord 137, cord 141, and charger 134. Then an electronic device 150 (FIG. 6) can be connected to the tip of cord 141 and can be conveniently placed on cradle 111, thereby allowing the electronic device to charge in a safe, easily accessible position.

FIG. 6 illustrates a second preferred exemplary embodiment of the electronic device charging platform and portable electrical outlet enclosure of the present invention, generally referred to by the reference numeral 100. The second exemplary embodiment of the electronic device charging platform and portable electrical outlet enclosure 100 is substantially similar to, and functions in a similar manner to, the first exemplary embodiment of FIG. 1 to FIG. 5, but additionally provides interior organizational securing devices 149 and non-slip mat 151. Furthermore, the second exemplary embodiment of the present invention illustrates the following three variations: 1. a generally more curvilinear shape 153, 154 for elements of the electronic device charging platform and portable electrical outlet enclosure 100, including left side wall 116, right side wall 117, right exterior rear wall 122, left exterior rear wall 124, front wall 113, central top section 115, top forward section 120, and top rearward section 121; 2. the location of latch 144 and its associated holding mechanism and release fitting 118 are disposed on top left rearward section 112 and top right rearward section 114, respectively, as opposed to the central top section 115 of the first exemplary embodiment; and 3. the connecting mechanism is illustrated as a fold line or flexible joint 152 disposed between bottom wall 119 and left side wall 116, such as might be molded or formed, for example, when bottom wall 119 and left side wall 116 are integrally molded from a polymer during manufacture.

One or more interior organizational securing devices 149 are disposed on the interior of right side wall 117 and are configured to provide convenient organization of cords 135 and/or cord 137. Securing devices 149 are illustrated as peg-like, but may alternately be generally shaped as rods or hooks or the like. Securing devices 149 may be formed integrally with right side wall 117 or may be attached by any conventional fasteners such as screws, nails, rivets, adhesives, or other fastening modalities.

Non-slip mat 151 is disposed on cradle 111 of top forward section 120 and is proportioned and configured to conveniently and securely hold a consumer electronic product 150. Non-slip mat 151 is a pad-like sheet of rubber or other natural or man-made non-slip material. In other aspects, the second exemplary embodiment is substantially similar to the first exemplary embodiment described above.

From the foregoing, it will be apparent that the compact and efficient platform and enclosure 100 of the current invention provides a convenient external platform location configured for the secure placement and charging of electronic devices and provides easy access to an internal area for installation of the portable electrical outlet device and for convenient placement and routing of power cords, plugs, transformers, and chargers. It also provides easy access to any cords and cord fittings extending out of the platform and enclosure 100. Furthermore, the platform and enclosure 100 increases safety by enclosing the portable electrical outlet device and consumer electronic product accessories away from children, from pets, and from spills. Thus the platform and enclosure 100 creates a functional structure to conceal a portable electrical outlet device and to organize plugs, wiring, transformers, chargers, and accessories of many everyday consumer electronic products, providing a safe, aesthetically pleasing, useful, and convenient place to localize and use these products, as well as a specially designed cradle for holding and charging an electronic device.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. An organizational enclosure for use with a portable electrical outlet device, with one or more electronic devices, and with one or more electrical cords, plugs, or charging components, comprising:

a right half comprising a right side wall, a front wall, a right exterior rear wall, a bottom wall, and a top wall; said top wall having a forward opening configured to accommodate one of said one or more electrical cords;

a left half connected to said top wall; said left half comprising a left side wall, a left top rearward section, and a left exterior rear wall; and said left half being movable between an open position and a closed position whereby said right half and said left half cooperatively define an interior space configured to allow installation of said portable electrical outlet device;

a cradle disposed on said top wall and configured to hold said one or more electronic devices;

a connecting mechanism configured for joining the lower edge of said left side wall to the outer edge of said bottom wall; and a latching mechanism configured for allowing the upper edge of said left half to be removably engaged with said top wall of said right half.

2. The organizational enclosure of claim 1, further comprising:

one or more exterior right rear slots disposed along the outer edge of said right exterior rear wall; and one or more exterior left rear slots disposed along the outer edge of said left exterior rear wall; whereby, when said left half is moved into a closed position, said one or more right exterior rear slots and said one or more left exterior rear slots cooperatively define one or more exterior conduits configured to accommodate said one or more electrical cords.

3. The organizational enclosure of claim 2, further comprising:

a first top notch disposed on the outer edge of said left top rearward section; and a second top notch disposed generally toward the back of said top wall and substantially aligned with said first top notch; whereby, when said left half is moved into a closed position, said first top notch and said second top notch cooperatively define an top conduit; whereby said one or more electrical cords can be accommodated by said top conduit.

4. The organizational enclosure of claim 3, further comprising:

a left interior rear wall extending perpendicularly from said left side wall into said interior space formed when said right half and said left half are in the closed position, said left interior rear wall disposed somewhat forward of said left exterior rear wall; and a right interior rear wall extending perpendicularly from said right side wall into said interior space formed when said right half and said left half are in the closed position, said right interior rear wall disposed somewhat forward of said right exterior rear wall.

5. The organizational enclosure of claim 4, further comprising:

one or more interior right rear slots disposed along the outer edge of said right interior rear wall; and one or more interior left rear slots disposed along the outer edge of said left interior rear wall; whereby, when said left half is moved into a closed position, said one or more interior right rear slots and said one or more interior left rear slots cooperatively define one or more interior rear wall conduits configured to accommodate said one or more electrical cords.

6. The organizational enclosure of claim 5, wherein said one or more right exterior right rear slots are evenly spaced along the outer edge of said right exterior rear wall; wherein said one or more exterior left rear slots are evenly spaced along the outer edge of said left exterior rear wall.

7. The organizational enclosure of claim 5, wherein said latching mechanism comprises at least one hook.

8. The organizational enclosure of claim 5, wherein said connecting mechanism comprises at least one hinge.

9. The organizational enclosure of claim 5, wherein said connecting mechanism comprises a flexible joint.

10. The organizational enclosure of claim 5, further comprising a mat disposed on the upper surface of said cradle, said mat configured to hold said one or more electronic devices.

11. The organizational enclosure of claim 10, wherein said mat is formed of a pad of non-slip man-made material.

12. The organizational enclosure of claim 10, wherein said mat is formed of a pad of rubber.

13. The organizational enclosure of claim 5, further comprising one or more securing devices generally extending perpendicularly from said right side wall into said interior space formed when said right half and said left half are in the closed position; wherein said securing devices are configured for organizing said one or more electrical cords.

14. The organizational enclosure of claim 13, wherein said securing devices are pegs.

15. The organizational enclosure of claim 13, wherein said securing devices are rods.

16. An electronic device platform and organizational enclosure, for use with a portable electrical outlet device and with one or more electronic devices and with one or more electrical cords, plugs, or charging components, comprising:

a right half comprising a right side wall, a front wall, a right exterior rear wall, a bottom wall, and a top wall; said top wall comprising a central top section, a top forward section, and a right top rearward section; said top forward section having a forward opening configured to accommodate said one or more electrical cords;

a left half comprising a left side wall, a left top rearward section, and a left exterior rear wall; said left side wall of said left half connected to said bottom wall of said right half by a connecting mechanism; and said left half being movable between an open position and a closed position whereby said right half and said left half cooperatively define an interior space configured to allow installation of said portable electrical outlet device;

a cradle disposed on said top forward section and configured to hold said one or more electronic devices;

a latching mechanism for removably fastening said left half to said right half;

one or more exterior right rear slots disposed along the outer edge of said right exterior rear wall;

one or more exterior left rear slots disposed along the outer edge of said left exterior rear wall; whereby, when said left half is moved into a closed position, said one or more right exterior rear slots and said one or more left exterior rear slots cooperatively define one or more exterior conduits configured to accommodate said one or more electrical cords;

a substantially U-shaped first top notch disposed on the outer edge of said left top rearward section;

a substantially U-shaped second top notch disposed on the outer edge of said right top rearward section; whereby, when said left half is moved into a closed position, said right top notch and said left top notch cooperatively define an smooth-edged top conduit; whereby said one or more electrical cords can be accommodated by said smooth-edged top conduit;

a left interior rear wall extending perpendicularly from said left side wall into said interior space formed when said right half and said left half are in the closed position, said left interior rear wall disposed somewhat forward of said left exterior rear wall;

a right interior rear wall extending perpendicularly from said right side wall into said interior space formed when said right half and said left half are in the closed position, said right interior rear wall disposed somewhat forward of said right exterior rear wall;

one or more interior right rear slots disposed along the outer edge of said right interior rear wall; and one or more interior left rear slots disposed along the outer edge of said left interior rear wall; whereby, when said left half is moved into a closed position, said one or more right interior rear slots and said one or more left interior rear slots cooperatively define one or more interior rear wall conduits configured to accommodate said one or more electrical cords.

17. The electronic device platform and organizational enclosure of claim 16, further comprising a non-slip mat disposed on the upper surface of said cradle, said mat configured to hold said one or more electronic devices.

18. The electronic device platform and organizational enclosure of claim 16, wherein said latching mechanism comprises at least one hook.

19. The electronic device platform and organizational enclosure of claim 16, wherein said connecting mechanism comprises a flexible joint.

20. The electronic device platform and organizational enclosure of claim 16, further comprising one or more securing devices generally extending perpendicularly from said right side wall into said interior space formed when said right half and said left half are in the closed position; wherein said securing devices are configured for organizing said one or more electrical cords.

* * * * *